US005658045A

United States Patent [19]

Van Koolwijk et al.

[11] Patent Number: 5,658,045

[45] Date of Patent: Aug. 19, 1997

[54] CHAIR WITH ADJUSTABLE SEAT AND BACKREST

[75] Inventors: Jan Van Koolwijk, Stuttgart; Reinhold Jokic, Bromskirchen, both of Germany

[73] Assignee: Kusch & Co. Sitzmobelwerke KG, Hallenberg, Germany

[21] Appl. No.: 540,980

[22] Filed: Oct. 11, 1995

[30] Foreign Application Priority Data

Oct. 11, 1994 [DE] Germany ..... 44 36 145.9

[51] Int. Cl.[6] ..... A47C 3/22

[52] U.S. Cl. ..... 297/300.5; 297/301.3; 297/301.4; 297/301.7

[58] Field of Search ..... 297/301.4, 300.5, 297/300.8, 301.3, 301.7, 362.12, 374, 375

[56] References Cited

U.S. PATENT DOCUMENTS

| | | | |
|---|---|---|---|
| 3,434,756 | 3/1969 | Walkinshaw | 297/301.4 |
| 4,125,288 | 11/1978 | Hunter | 297/301.7 X |
| 4,384,741 | 5/1983 | Flum et al. | 297/300.8 X |
| 4,709,963 | 12/1987 | Uecker et al. | 297/300.5 |
| 5,069,496 | 12/1991 | Kunh et al. | 297/344.19 X |
| 5,397,165 | 3/1995 | Grin et al. | 297/300.5 |
| 5,447,357 | 9/1995 | Dauphin | 297/301.4 |

*Primary Examiner*—Peter M. Cuomo
*Assistant Examiner*—Stephen Vu
*Attorney, Agent, or Firm*—Young & Thompson

[57] ABSTRACT

Chair (1) with tilt mechanism for synchronous adjustment of a seat (4) and a backrest (6) which are swivel mounted on a base (8), from a normal working position in which the seat (4) assumes a horizontal position and the backrest (6) a vertical position, into positions with a different inclination of the seat (4) and backrest (6) and with height adjustment for the seat and backrest. The position of the seat (4) and backrest (6), as adjusted by a catch mechanism, is released easily by pulling up an actuation lever attached laterally under a seat support (3) on the base (8) of the swivel chair (1) and by leaning lightly against the backrest (6) to release it from a restoration spring (16) of the tilt mechanism acting on the seat support (3) with the seat (4) and the back (6). In order to adjust the desired normal working position or a more or less inclined position of the seat (4) and backrest (6), the actuation lever need simply be pressed down. The catch mechanism then causes automatic fixing of the seat (4) and backrest (6) in the desired position which is achieved by leaning back or bending forward the upper body.

5 Claims, 6 Drawing Sheets

CHAIR WITH ADJUSTABLE SEAT AND BACKREST

FIELD OF THE INVENTION

The invention relates to seating furniture, especially office chairs, with tilt mechanism for synchronous adjustment of the seat and backrest which are swivel mounted on a base, from a normal working position in which the seat assumes a horizontal and the backrest a vertical position, into positions with a different incline of the seat and backrest and with height adjustment for the seat and backrest.

BACKGROUND OF THE INVENTION

Seating furniture of the generic type known from DE 86 30 390.2 U1 are equipped with complicated tilt mechanism for synchronously swivelling the seat and backrest, which occupies a relatively large amount of space for installation under the seat, by which the appearance of the seating furniture is adversely affected.

SUMMARY OF THE INVENTION

The object of the invention is to develop seating furniture with tilt mechanics which is characterized by a simple, compact construction and optimum operating safety.

The flat construction of the tilt mechanism of the seating furniture enables its installation in a shell-like housing of low height so that the external appearance of the seating furniture is in no way adversely affected by the tilt mechanism. The position of the seat and backrest which can be adjusted by a catch mechanism is released easily by pulling up an actuating lever attached laterally under the seat support on the base of the seating furniture and by leaning lightly against the backrest to release it from the restoration spring of the tilt mechanism acting on the seat support and the back. In order to adjust the desired normal working position or a more or less inclined position of the seat and backrest, the actuation lever need simply be pressed down. The catch mechanism then causes automatic fixing of the seat and backrest in the desired position which is achieved by leaning back or bending forward the upper body.

BRIEF DESCRIPTION OF THE DRAWINGS

The invention is explained below using schematic drawings.

DETAILED DESCRIPTION OF THE INVENTION

Figure 1A:
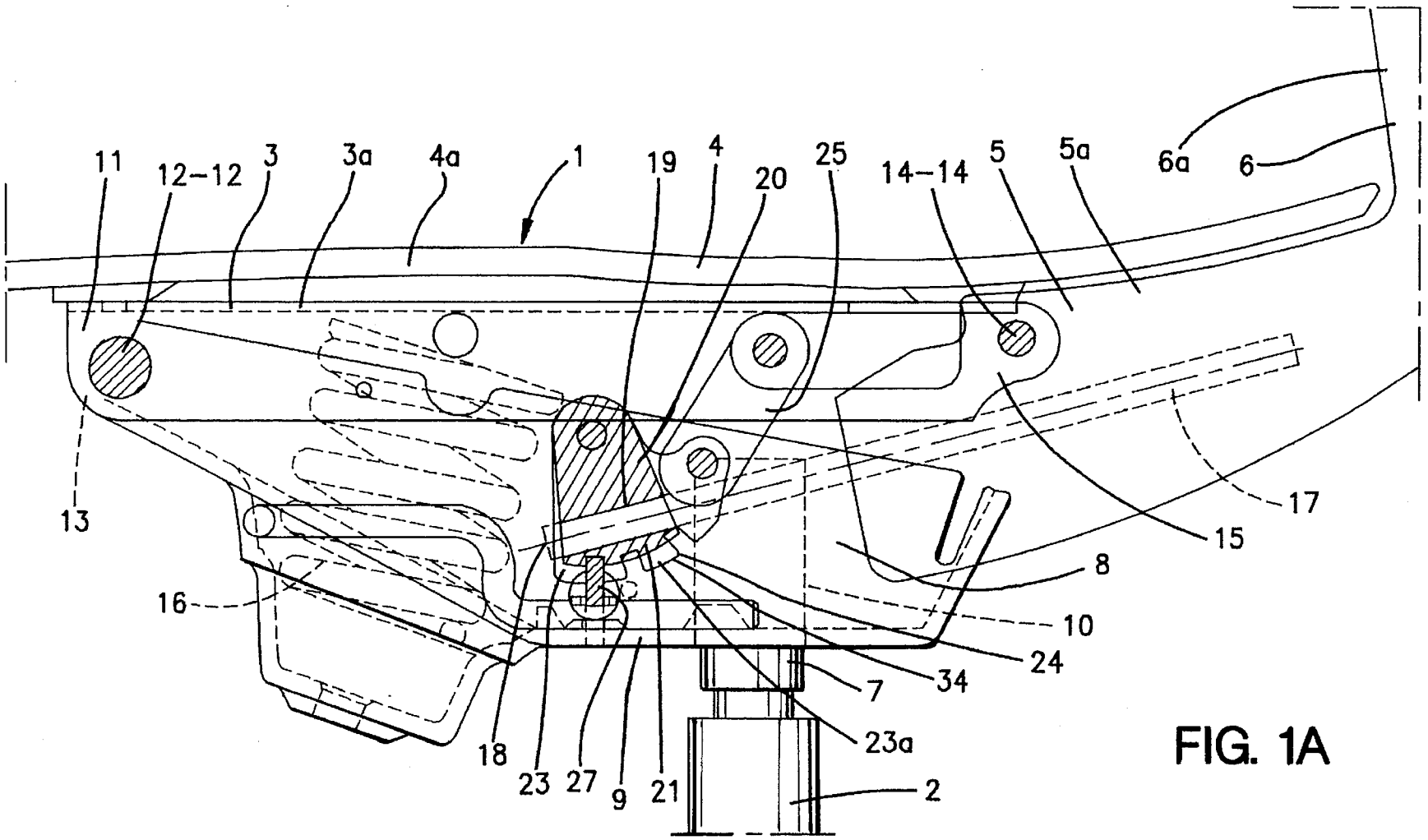
FIG. 1*a* through 1*c* show inside views of the base of a swivel chair with tilt and catch mechanism in the normal seat position, a position of the seat support and backrest support tilted more or less strongly to the rear.
Figure 1B:
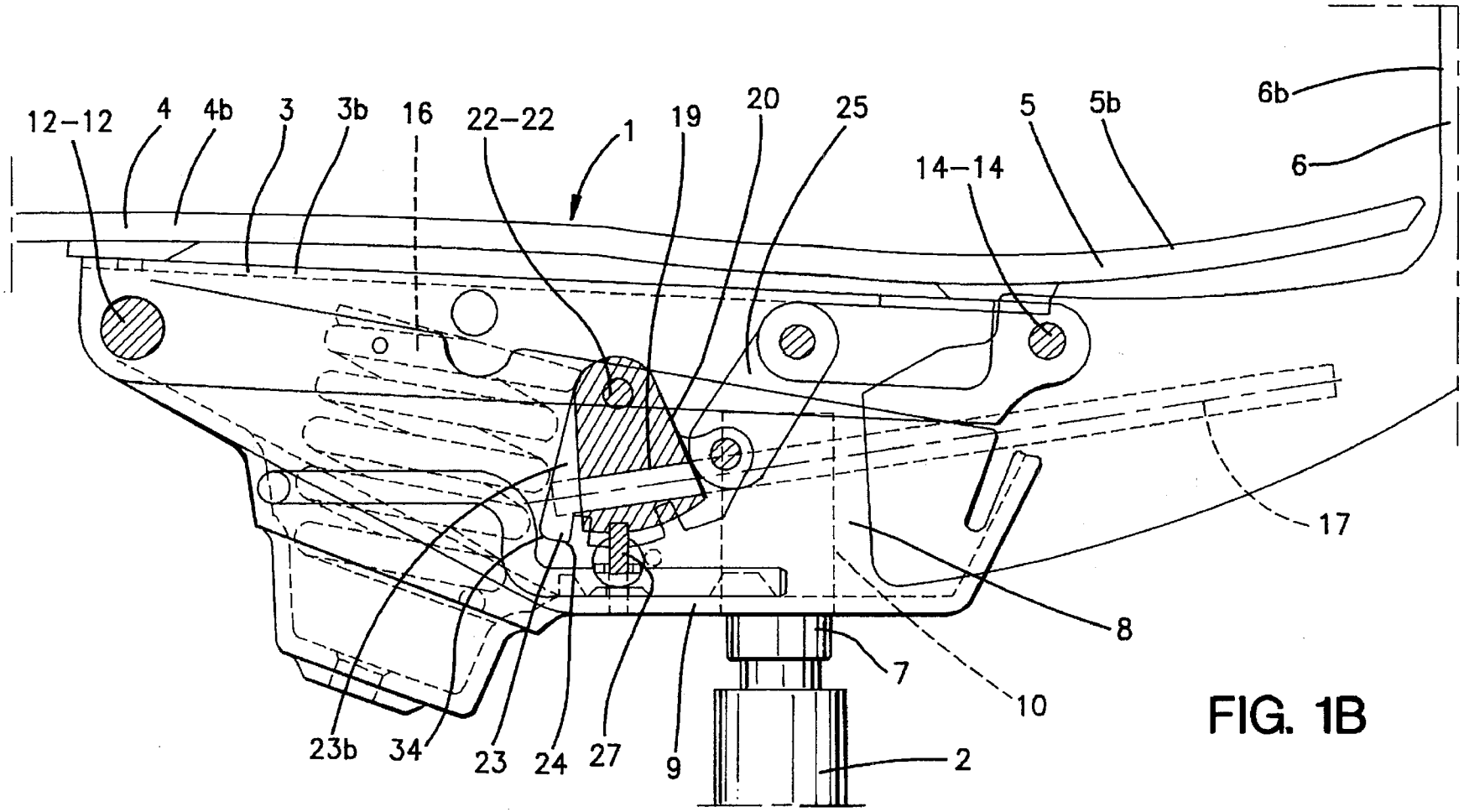
Figure 1C:
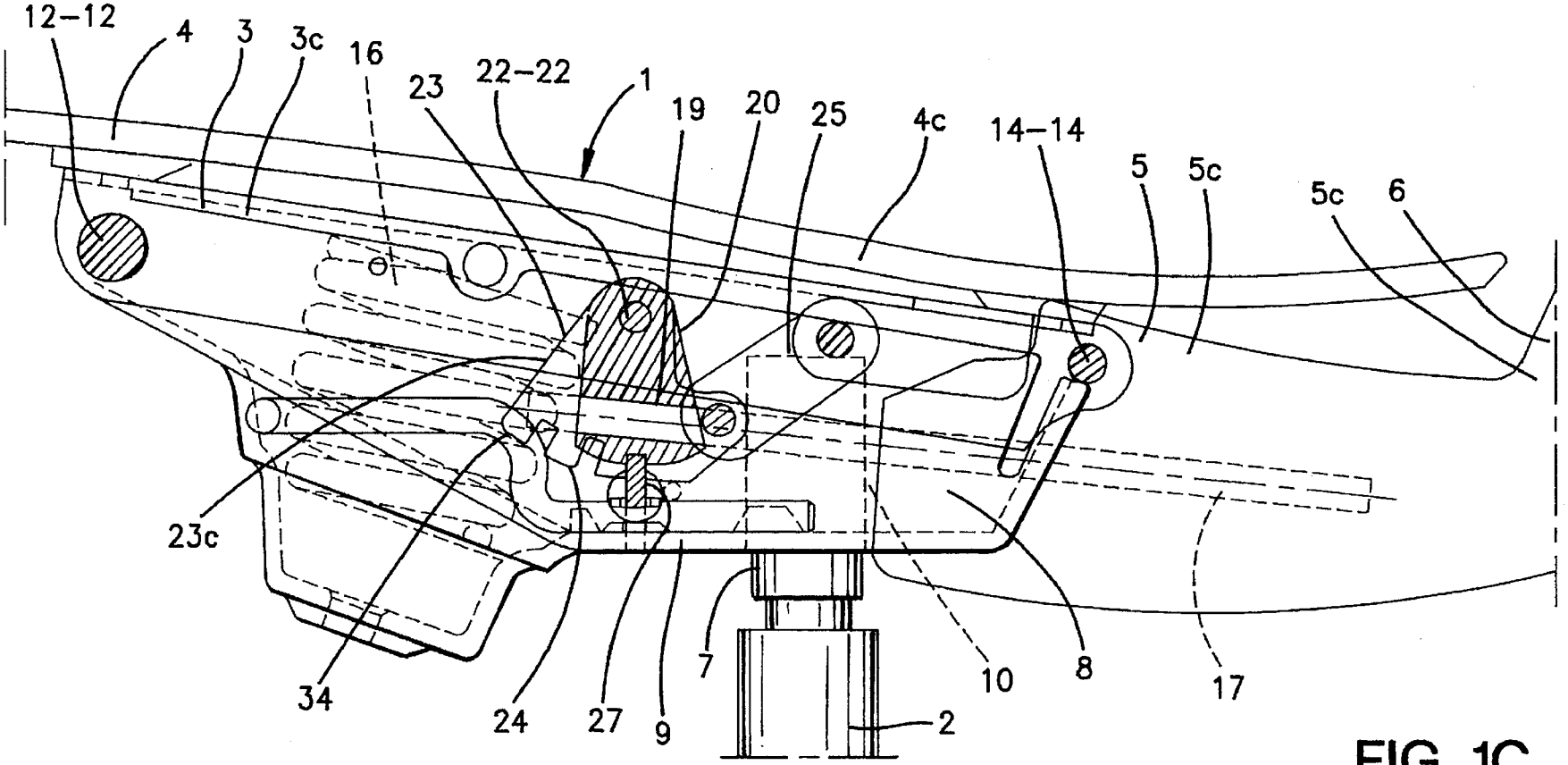
Figure 2:
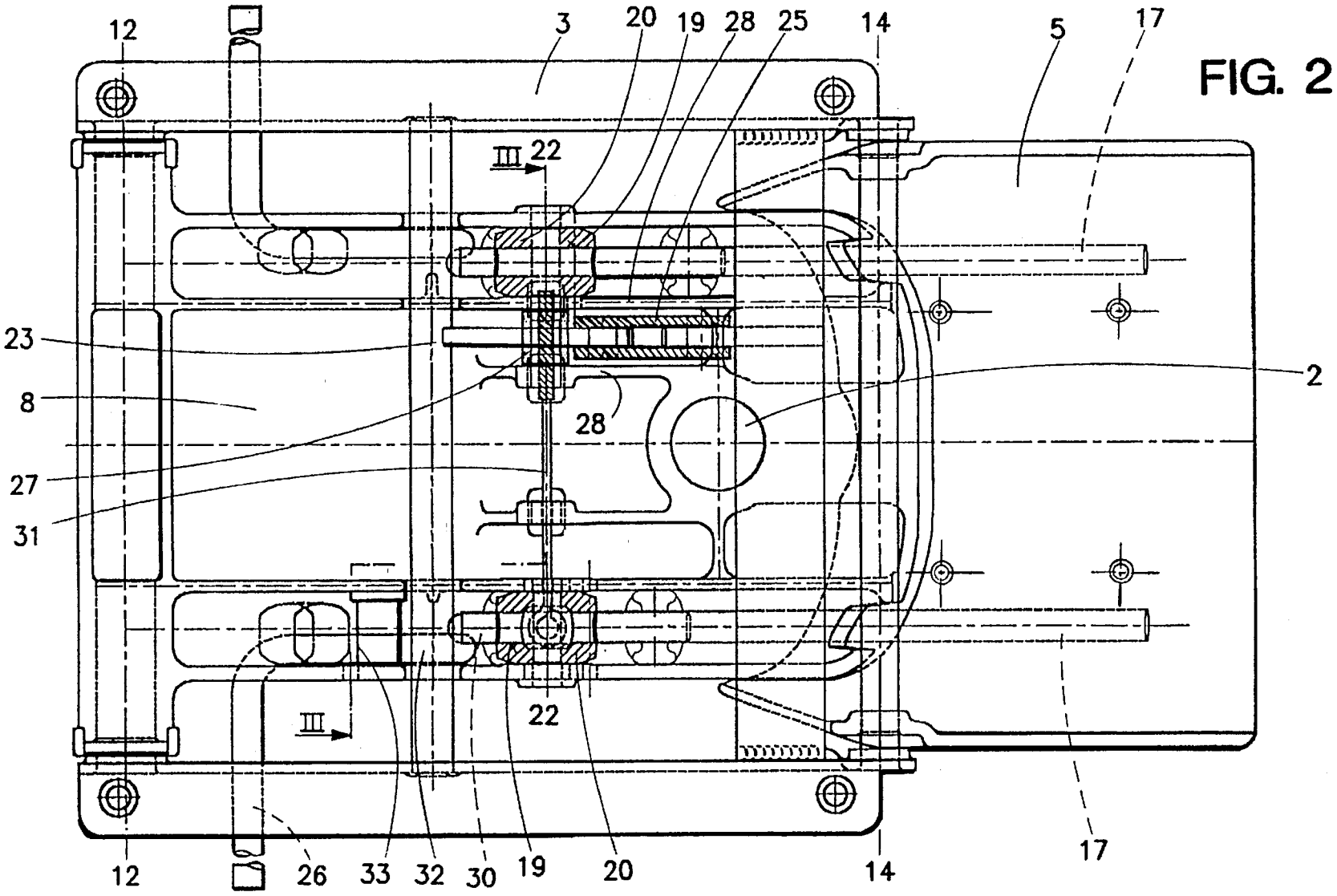
FIG. 2 shows an overhead view of the base and FIG. 3*b* each show a section according to line III—III of FIG. 2 to illustrate the catch mechanism for the tilt mechanism of the swivel chair in the engaged and disengaged position of the bolt of the catch mechanism.
Figure 3A:
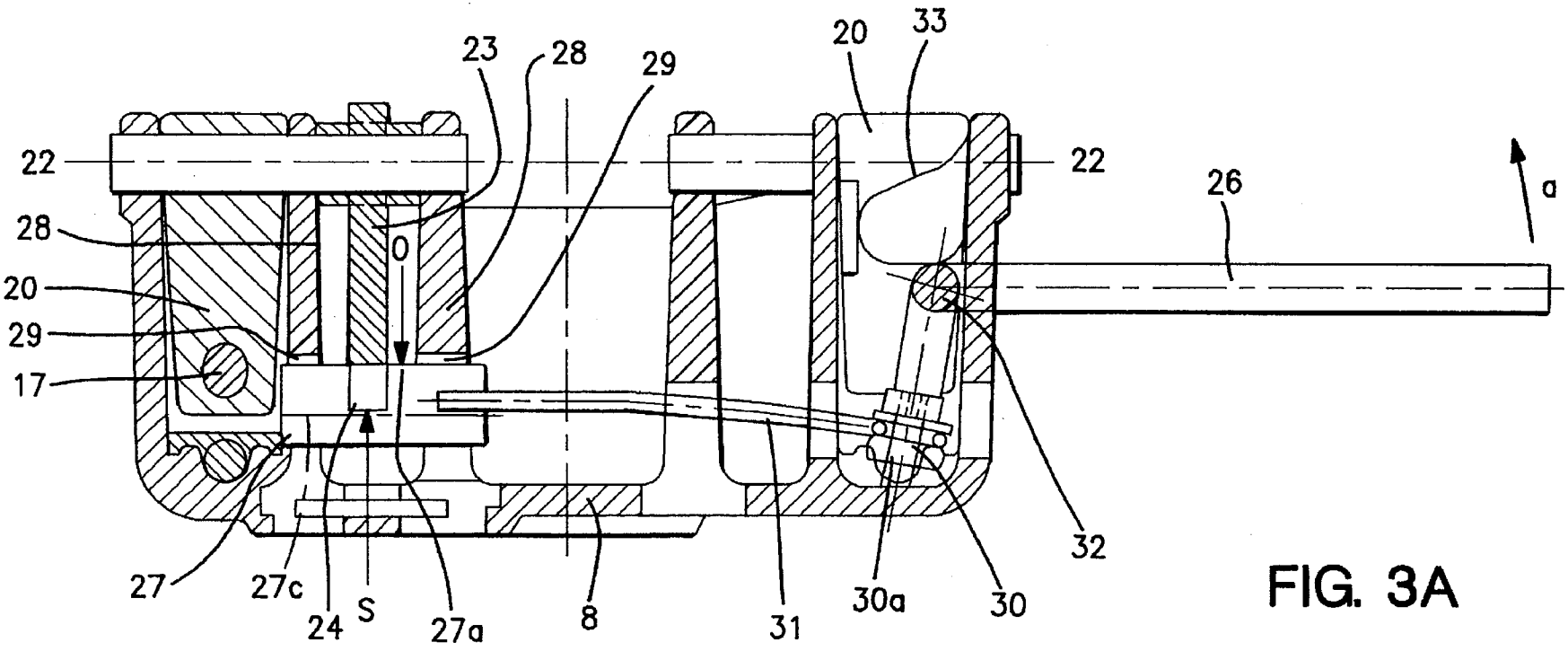
Figure 3B:
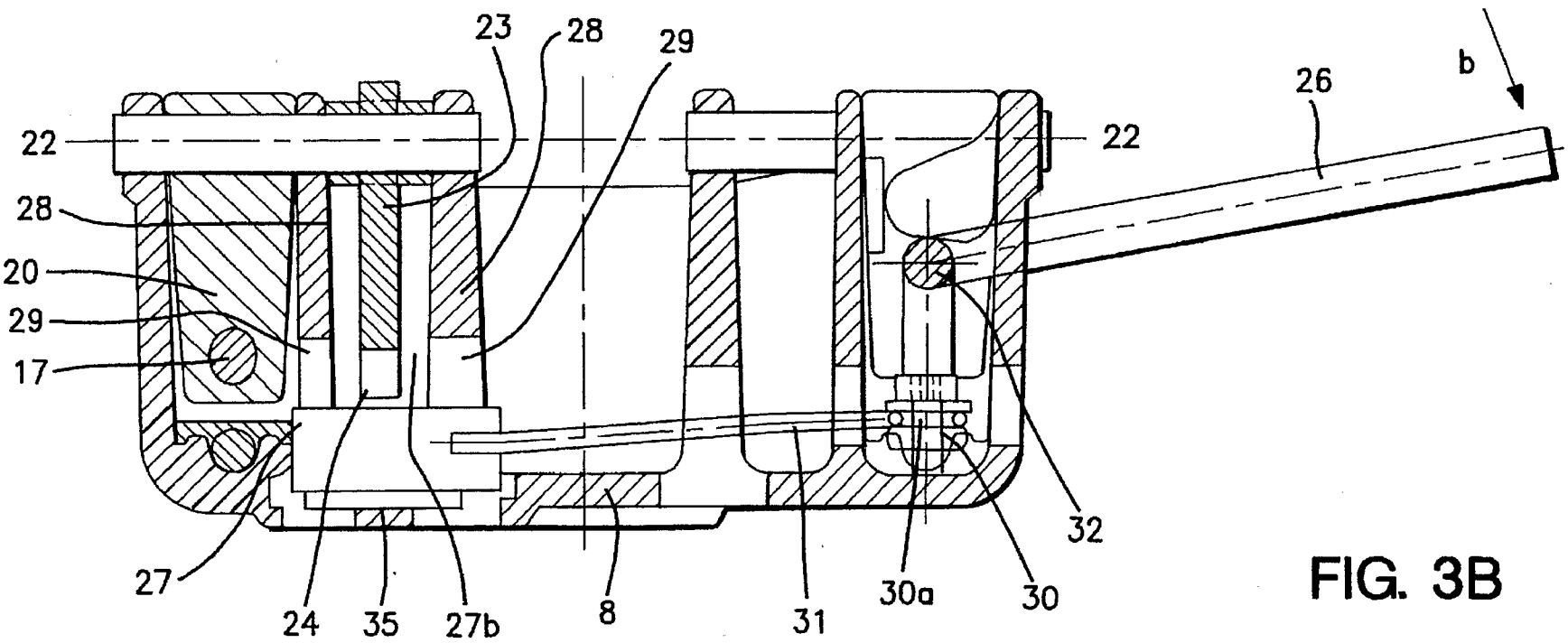

Swivel chair 1 according to FIG. 1*a*through 1*c* has a base which is not shown, with a base cross which is equipped with castors, an upright cylindrical member attached to the base cross, and gas pressure spring installed in the upright member for vertical adjustment of seat support 3 with seat 4 attached to it and of backrest support 5 with backrest 6. Gas pressure spring 2 acts on forcing lever 7 which engages correspondingly conically shaped holding sleeve 10 in base 8 with a conically shaped end through bottom 9 of base 8 to hold the tilt mechanism for synchronous swivelling of seat 4 and backrest 6 and the catch mechanism of swivel chair 1.

Seat 4 and backrest 6 of swivel chair 1 can be swivelled with the tilt mechanism and catch mechanism which are described below into normal seat position 4*a*, 6*a*, position 4*b*, 6*b* slightly tilted to the rear, and into position 4*c*, 6*c* tilted more strongly to the rear and can be locked in these three positions.

Seat support 3 is mounted with front 11 to swivel around horizontal axle 12—12 on face 13 of base 8. Backrest support 5 is swivel mounted on rear 15 of seat support 3 on swivel axle 14—14 which is parallel to swivel axle 12—12 of seat support 3.

Prestressed restoration spring 16, made as a compression spring, with adjustable stiffness for swivelling seat support 3 and backrest support 5 up from highly inclined position 3*c*, 5*c* into middle inclined position 3*b*, 5*b* or normal seat position 3*a*, 5*a* is installed in base 8 of swivel chair 1.

In backrest support 5 two push rods 17 of limited elasticity for synchronizing the swivel motion of seat support 3 and backrest support 5 and for supporting backrest support 5 are permanently located on base 8 of swivel chair 1. Two push rods 17 of backrest support 5 are pointed transversely to swivel axles 12—12 and 14—14 of seat support 3 and backrest support 5 and are movably supported with their free front end 18 in slide bearing 19 in free end 21 of one swivel arm 20 each, two swivel arms 20 being swivel mounted on axle 22—22 parallel to swivel axles 12—12 and 14—14 in base 8 of swivel chair 1.

The catch mechanism built into base 8 of swivel chair 1 for locking seat support 3 and backrest support 5 in different positions 3*a*–3*c*, 5*a*–5*c* is equipped with catch bracket 23 which has three recesses 24 according to the three possible positions 3*a*–3*c*, 5*a*–5*c* of seat support 3 and backrest support 5 and which is swivel mounted on swivel axle 22—22 of swivel arm 20 with slide bearing 19 for push rods 17 of backrest support 5. Support bracket 23 is attached to seat support 3 with connecting rod 25.

Actuation lever 26 is built into base 8 of swivel chair 1 for locking catch bracket 23 in positions 23*a*–23*c* which correspond to normal position 3*a*; 5*a* and two inclined positions 3*b*, 3*c*; 5*b*, 5*c* of seat support 3 and backrest support 5, with base 8 via bolt 27 which fits into respective catch recess 24 of catch bracket 23 and two guide slots in two spaced stiffening ribs 28 of base 8.

Actuation lever 26 engages torsion bar 30 supported in base 8 of swivel chair 1 and on the bar a spring element pointed transversely to it is attached which for example is formed as bar spring 31, on the free end of which bolt 27 of the catch mechanism is attached. Bolt 27 is held by prestressed bar spring 31 in locked-in position 27*a* and unlocked position 27*b*.

Torsion bar 30 for locking and unlocking bolt 27 is held by torsion spring 33 which acts on an elbow 32 of the rod in locked-in position 30*a* and unlocked position 30*b*.

For synchronous adjustment of seat support 3 with seat 4 and backrest support 5 with backrest 6 from normal position 3*a*, 4*a*; 5*a*, 6*a* into one of two inclined position 3*b*, 4*b*; 5*b*, 6*b* or 3*c*, 4*c*; 5*c*, 6*c* or from one inclined position into the other inclined position or the normal position, actuation lever 26 is pulled upward in arrow direction a so that torsion bar 30 turns into position 30b and prestressed bar spring 31 with opening force 0 acts on bolt 27 which is engaged in recess 24 of catch bracket 23 and which is clamped by the force of restoration spring 16 of the tilt mechanisms which acts on seat support 3 and backrest support 5 in recess 24 of catch bracket 23. By leaning lightly against backrest 6 bolt 27 is relieved of the clamping force caused by restoration spring 16 and by the action of opening force 0 applied by prestressed bar spring 31 disengages from catch bracket 23 into position 27*b*, the impact noise which occurs when bolt 27 is disengaged being damped by plastic plate 35 attached to bottom 9 of frame 8 of swivel chair 1. By subsequently pressing down actuation lever 26 in arrow direction b torsion bar 30 is turned into position 30*a*, by which bolt 27 with torsion spring 31 is swivelled into intermediate position 27*c* against periphery 34 of catch bracket 23 and bar spring 31 is prestressed with closing force S. In the synchronous adjustment of seat 4 and backrest 6 caused by the individual sitting in swivel chair 1 subsequently bending forward or leaning back catch bracket 23 with periphery 34 slides over stationary bolt 27 such that the latter fits automatically under the action of closing force S of bar spring 31 into next recess 24 of catch bracket 23 and seat 4 and backrest 6 of swivel chair 1 are locked in the desired position.

We claim:

1. A chair comprising:

a tilt mechanism for synchronous adjustment of a seat and backrest which are swivel mounted on a base, from a normal seating position into different inclination and height adjustment positions for the seat and the backrest;

a seat support (3) having a front side (11) swivel mounted around a horizontal axis (12—12) on said base;

a backrest support (5) which is swivel mounted on a rear side (15) of said seat support (3) on an axis (14—14) parallel to said horizontal axis (12—12) of the seat support;

a restoration spring (16) which is a compression spring in said base (8) for urging said seat support (3) and backrest support (5) from a highly inclined position (3*c*, 5*c*) into a middle inclined position (3*b*, 5*b*) or upright seat position (3*a*, 5*a*);

push rods (17) secured to, said backrest support (5) for synchronizing the swivel motion of said seat support (3) and backrest support (5) and for supporting said backrest support (5) on said base (8) of said chair (1), said push rods (17) of said backrest support (5) being disposed transversely to said axes (12—12, 14—14) of said seat support (3) and backrest support (5) and being movably supported at free front ends (18) of said rods (17) in free ends (21) of swivel arms (20) which are swivel mounted on an axis (22—22) parallel to said axes (12—12, 14—14) of said seat support (3) and backrest support (5) in said base (8) of said chair (1);

a catch mechanism for locking said seat support (3) and backrest support (5) in different various inclined and upright positions (3*a*—3*c*, 5*a*—5*c*), said catch mechanism having a catch bracket (23) which has a number of recesses (24) which corresponds to the different various inclined and upright (3*a*—3*c*, 5*a*—5*c*) of said seat support (3) and backrest support (5) of said chair (1), and being swivel mounted on said axis (22—22) of said swivel arm (20) with a slide bearing (19) for said push rods (17) of said backrest support (3);

a connecting rod (25) which is connected to said catch bracket (23) and seat support (3);

an actuating lever (26) built into said base (8) of said chair (1) for locking said catch bracket (23) in said different positions (23*a*—23*c*) of said seat support (3) and backrest support (5) with said base (8) via a bolt (27) which fits into respective catch recesses (24) of said catch bracket (23) and into at least one guide slot (29) in said base (8); and a spring element (31) which can be prestressed by actuation of said lever (26) and which acts on said bolt (27) for automatically engaging and disengaging said bolt (27) into or out of a said recess (24) of said catch bracket (23) according to the desired upright (4*a*; 6*a*) or inclined position (4*b*, 4*c*; 6*b*, 6*c*) of said seat (3) and backrest (5) of said chair (1).

2. A chair according to claim 1, wherein said actuating lever (26) engages a torsion bar (30) supported in said base (8) of said chair (1), a transverse bar spring (31) having a first end attached to said torsion bar, said bolt (27) of the catch mechanism is attached to a second end of said transverse bar spring, said bolt (27) being held in a locked-in position (30*a*) and an unlocked position (30*b*) by alternatively prestressing said bar spring (31) in the locked-in position (27*a*) and the unlocked position (27*b*) and by said torsion bar (30) for engaging and disengaging said bolt (27) by a spring element (33) which engages the torsion bar, in the synchronous adjustment of said seat support (3) and backrest support (5) into a desired upright position (3*a*, 5*a*) or inclined position (3*b*, 3*c*;5*b*, 5*c*), said bolt (27) being disengaged from said catch bracket (23) by turning said torsion bar (3) by means of said actuation lever (26) into said locked-in position (30*a*) and being acted upon by said prestressed bar spring (31) with a closing force (S) such that said bolt (27) automatically locks into a next catch recess (24) of catch bracket (23) which slides with its periphery (34) over said bolt (27) when said seat support (3) is swivelled up and down and said (4) and backrest (6) are locked in the desired position.

3. A chair according to claim 2, further comprising a torsion spring (33) acting on an elbow (32) of said torsion bar (30) of said actuating lever (26) for holding said torsion bar (30) in said locked-in position (30*a*) or unlocked position (30*b*).

4. A chair according to claim 1, wherein said push rod (17) of said backrest support (5) have limited flexibility.

5. A chair according to claim 1 wherein said restoration spring (16) has an adjustable spring stiffness for urging upward said seat support (3) and backrest support (5).

* * * * *